United States Patent [19]

Paul

[11] Patent Number: 4,978,227

[45] Date of Patent: Dec. 18, 1990

[54] BLENDER FOR SOLID PARTICULATE MATERIAL

[75] Inventor: Kermit D. Paul, Bethlehem, Pa.

[73] Assignee: Fuller Company, Bethlehem, Pa.

[21] Appl. No.: 848,005

[22] Filed: Apr. 3, 1986

[51] Int. Cl.[5] ..... B01F 13/02

[52] U.S. Cl. ..... 366/101; 366/137; 366/150

[58] Field of Search ..... 366/341, 107, 106, 101, 366/9, 3, 10, 137, 138, 603, 150; 406/181, 93, 94, 95

[56] References Cited

U.S. PATENT DOCUMENTS

| | | | |
|---|---|---|---|
| 3,216,629 | 11/1965 | Goins | 366/159 |
| 3,386,707 | 6/1968 | Brown | 366/107 |
| 3,756,569 | 9/1973 | Wohlforth | 366/106 |
| 4,353,652 | 10/1982 | Young | 366/193 |
| 4,478,517 | 10/1984 | Hoppe et al. | 366/341 |
| 4,560,285 | 12/1985 | Fisher | 366/341 |
| 4,573,800 | 3/1986 | Lasso et al. | 366/101 |

FOREIGN PATENT DOCUMENTS

| | | | |
|---|---|---|---|
| 2812092 | 10/1979 | Fed. Rep. of Germany | 366/9 |
| 2562046 | 10/1985 | France | 406/93 |

*Primary Examiner*—Harvey C. Hornsby

*Assistant Examiner*—Joseph S. Machuga

*Attorney, Agent, or Firm*—Frank H. Thomson; Daniel De Joseph

[57] ABSTRACT

Apparatus for blending solid particulate material which includes a center lift or blending column with gaseous fluid under pressure supplied to the bottom of the column for entraining material in the vessel and lifting it up through the column to circulate material within the vessel. Recycle channels are provided on the periphery of the vessel for withdrawing material at various heights and supplying it to the bottom of the vessel for recirculation through the lift column. Each of the recycled channels includes a plurality of vertically spaced apart inlet openings each with a baffle positioned therein to permit material to simultaneously enter the recycle channel at more than one point along the height of the vessel. These baffles may be equipped with operators to selectively position the baffle to control the flow of material into the recycle channel. The apparatus also includes an arrangement defining a seal leg at the bottom of the vessel to ensure proper recycle of material through the apparatus. The apparatus preferably is used with a bottom filling arrangement so that the energy used for supplying material to the vessel is utilized for blending material.

14 Claims, 2 Drawing Sheets

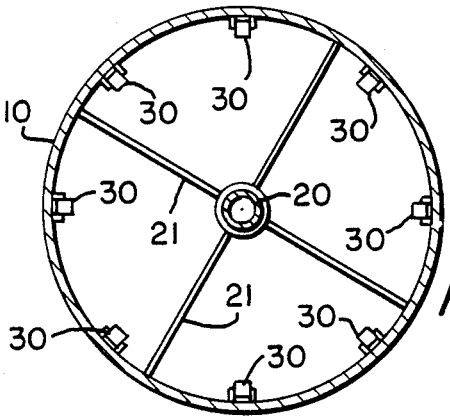
FIG. 3
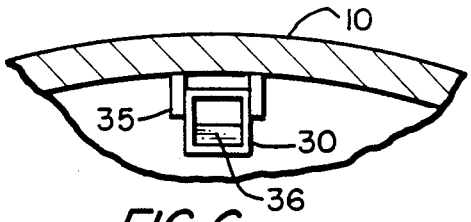
FIG. 6
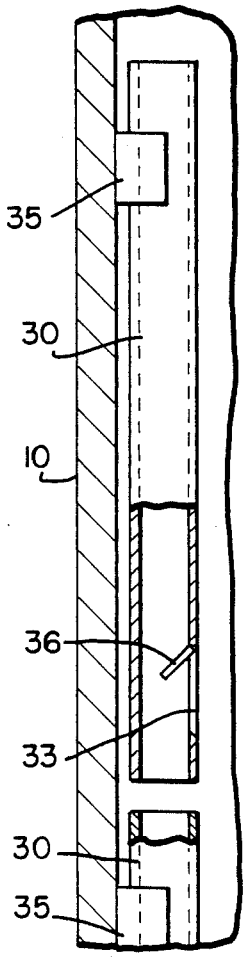
FIG. 7
FIG. 4
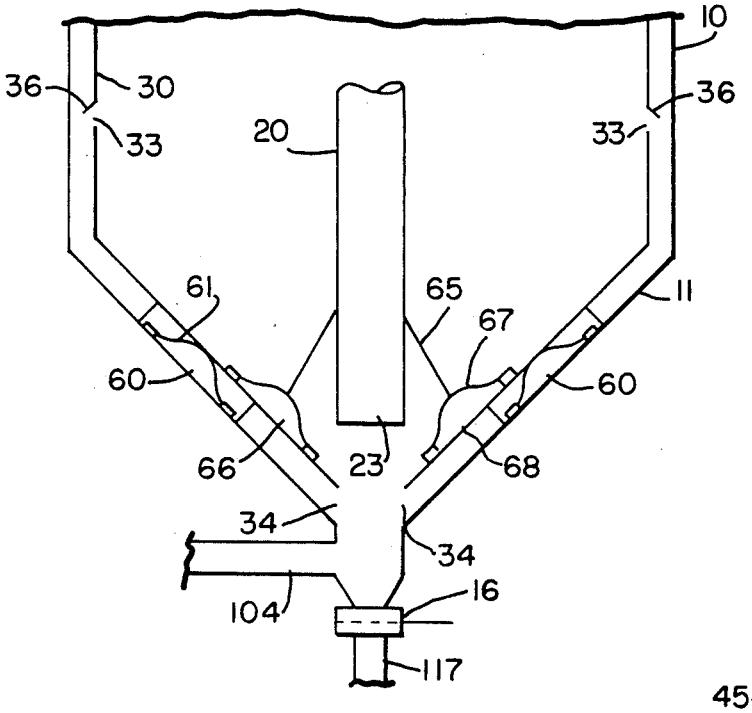
FIG. 8
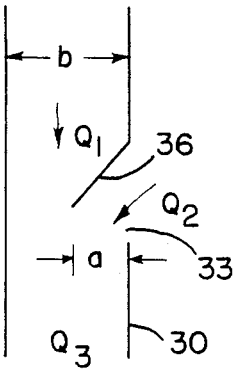
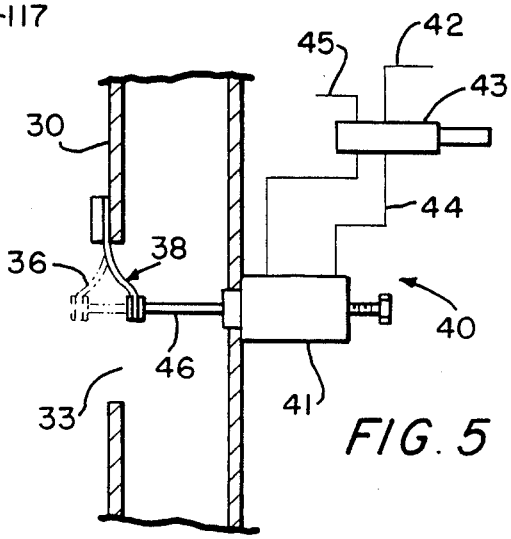
FIG. 5

BLENDER FOR SOLID PARTICULATE MATERIAL

BACKGROUND OF THE INVENTION

This invention relates to a blender for solid particulate material such as plastic pellets. The invention combines the features of those blenders utilizing a central lift or blending column with the features of those blenders using recycle channels (downcomers) in a gravity flow system. The invention is also capable of utilizing a bottom fill technique for utilizing the energy used to supply material to the blending vessel for the purpose of blending the particulate material by means of material recirculation.

Prior to the present invention, material blenders were known which included a vertically oriented vessel with a centrally mounted lift column for recirculating material within the vessel. Typical examples of such blenders are shown for example in U.S. Pat. Nos. 3,276,753; 3,642,178; and 4,194,845.

Also prior to the present material blenders of the gravity type were known. Blenders of this type include a vertically oriented vessel with a plurality of downcomers each having inlets at various levels in the vessel. Material in the upper part of the vessel enters the downcomers into a receiving bin or hopper so that material from various levels in the vessel are mixed. In some instances a material recirculation system is provided Typical examples of such blenders are shown for example in U.S. Pat. Nos. 3,158,362; 3,216,629; 3,421,739 and 4,068,828.

Prior to the present invention it was also known to utilize a bottom fill technique with a central lift column for blending solid particulate material such as plastic pellets. Such apparatus are generally shown in U.S. Pat. No. 4,569,596 and U.S. patent application Ser. No. 680,213 filed Dec. 10, 1984, now U.S. Pat. No. 4,573,800 both assigned to the assignee of the present invention. In this type of system, the material to be blended is pneumatically conveyed from a source of material to the bottom of the blender and the energy utilized for conveying the material to the blender is used to lift the material up the central lift column entraining material already in the vessel lifting the same to the top of the vessel and thereby blending the material.

In order to improve the supply of material from the top of the vessel to the lift column attempts have been made to utilize recirculation channels or internal downcomers in combination with a central lift or blending column. One such arrangement is shown in U.S. Pat. No. 3,386,707 issued June 4, 1968. When an attempt was made to combine the central lift column with peripherial downcomers or recycle channels and bottom filling of the vessel it is discovered that there is no adequate improvement in the recirculation of material from the top of the vessel down to the lift column to join the fresh material being supplied to the blender. The gaseous fluid under pressure used to lift material up through the blending or lift column tends to be diverted from being directed up the lift column to fluidize material in the vessel thereby bypassing the lift column and interfering with material recirculation.

U.S. Pat. No. 3,386,707 attempted to solve this problem by utilizing a belled lift pipe, but in this apparatus the recirculating air supplied to the lift pipe is supplied through either a vacuum or through a conduit which extends into the lift pipe. Neither of these arrangement is suitable for a bottom filled vessel.

In blenders utilized for blending solid particulate material such as plastic pellets which utilize a gravity type apparatus for recirculating material, it is known that if a vertical recycle channel or downcomer is placed in the blending vessel and that recycle channel includes a plurality of vertically spaced apart openings along its length, material will normally only flow into the channel from the uppermost opening which is buried in the vessel. Thus, despite the several openings in the channel, material only flows into the uppermost opening down through the channel to the channel's outlet. Once the level of material in the vessel falls below an opening in the recirculating channel, then material will start flowing into the channel in the next lower opening.

It is known from U.S. Pat. Nos. 4,560,285 issued Dec. 24, 1985; 4,068,828 issued Jan. 17, 1978 and 3,216,629, issued Nov. 9, 1965, that if a baffle is placed in the channel opening then there will be flow of material into the channel not only from the uppermost channel inlet, but also a lower channel inlet which includes the baffle. As used in a gravity type blender, this creates the ability to withdraw material from not only the uppermost point in the vessel, but also from a lower point to thereby improve blending efficiency.

With prior practice such as illustrated in the above referenced patents, recirculation of the material is typically through an external means whereby material is withdrawn through the channels, supplied to a pneumatic conveying system, recirculated outside the vessel to the top of the vessel for further blending. In addition, in such apparatus, once the position of the blender openings is set by location of the baffle arrangements, no suitable arrangement is provided for controlling the withdrawal of material from various levels in the blender. While U.S. Pat. No. 4,560,285 considers an adjustable baffle, it would be useful to provide some means external to the vessel for adjusting the level in the blender from which material flows into the recycle channels so that in some instances material may be supplied to the recycle channel from the uppermost opening and the next lower opening or from the uppermost opening and an opening further down the recycle channel. It would also be useful to provide some means for controlling flow of material through the downcomers.

SUMMARY

It is therefore the principal object of this invention to provide a blender for solid particulate material which utilizes the energy used for supplying material to the vessel for blending material already in the vessel and provides improved mixing of material already in the vessel with fresh material being supplied to the vessel.

It is a further object of this invention to provide a gravity type blender which has flexibility to permit blending of material withdrawn from various levels in the blending apparatus.

In general, the foregoing and other objects will be carried out by providing an apparatus for blending solid particulate material comprising a vertically oriented vessel having an upper part and a lower part, an inlet for particulate material to be blended, an outlet for blended particulate material and a tubular extension on the lower part thereof; a vertical lift column centrally mounted in said vessel having a lower part extending into said tubular extension and including an inlet within said tubular extension and an outlet in the upper part of the vessel; at least one recycle channel associated with said vessel having at least one inlet for receiving particulate material from the upper part of the vessel and an outlet for returning particulate material to the lower part of the vessel; means for supplying gaseous fluid under pressure to said tubular extension below said lift column for entraining material in the tubular extension into the inlet of the lift column and upwardly through the lift column whereby material is discharged from the outlet of said lift column in a geyser-like manner into the upper part of the vessel; said tubular extension and the lift column being dimensioned to define a seal leg to enable a major portion of said gaseous fluid to be directed upwardly through the lift column.

The objects of the invention will also be carried out by providing in an apparatus for blending solid particulate material including a vertically oriented vessel having an upper part, a lower part, an inlet for material to be blended and an outlet for blended material and at least on generally vertical recycle channel associated with said vessel having at least one inlet communicating with the upper part of the vessel and an outlet, the improvement comprising a movable flow control deflector operatively associated with the said inlet for controlling the flow of material into said recycle channel, the inlet of said recycle channel being a generally horizontal opening and said flow control deflector includes a baffle for partially controling said horizontal opening and means for moving said baffle between a position where the baffle extends partially into the channel and a position where the baffle extends out of the channel.

Basically, the invention includes a vertically oriented vessel with a plurality of recycle channels circumferentially spaced around the inside of the vessel. Each of these channels has a plurality of vertically spaced apart inlet openings each with an adjustable valve positioned therein. The vessel includes a tubular extension extending downwardly at the bottom of the vessel. A centrally mounted lift or blending column is mounted in the vessel and extends into the tubular extension to define a seal leg. Particulate material to be blended may be supplied either from into the top of the vessel or in the preferred form, into the bottom of the vessel for passage directly upwardly through the vertical lift column using the energy used to supply the material to the blender. Material already in the vessel moves by gravity down through the recycle channels to the area of the seal leg for entrainment with the incoming material up through the blending column. The outlets of the recycle channels are placed near the top of the seal leg and the inlet for the lift column is placed near the bottom of the seal leg.

The means for controlling the flow of material into the recycle channels includes a moveable flow controlled deflector which may be positioned between extreme positions of extending into the channel or extending out of the channel into the vessel. By the present invention it has been discovered that if the moveable deflector extends into a channel, material will flow into that channel from both the uppermost opening in the channel and a lower opening. If the moveable deflector extends out of the channel, then material will not flow into that channel unless it is the uppermost opening in the channel.

The invention also includes a valve means which may be placed in each recycle channel to control flow of material through that channel.

BRIEF DESCRIPTION OF THE DRAWINGS

The invention will be described in connection with the annexed drawings wherein:

FIG. 3 is a sectional view of the apparatus according to the present invention;

FIG. 4 is a diagramatic view of a modification of the present invention;

FIG. 5 is a detailed view of a portion of the present invention;

FIG. 6 is a sectional view taken on the lines 6—6 of FIG. 2; and

FIG. 7 is a detailed view of a portion of the present invention.

FIG. 8 is a diagrammatic view of a portion of the present invention.

DESCRIPTION OF THE PREFERRED EMBODIMENTS

Figure 1:
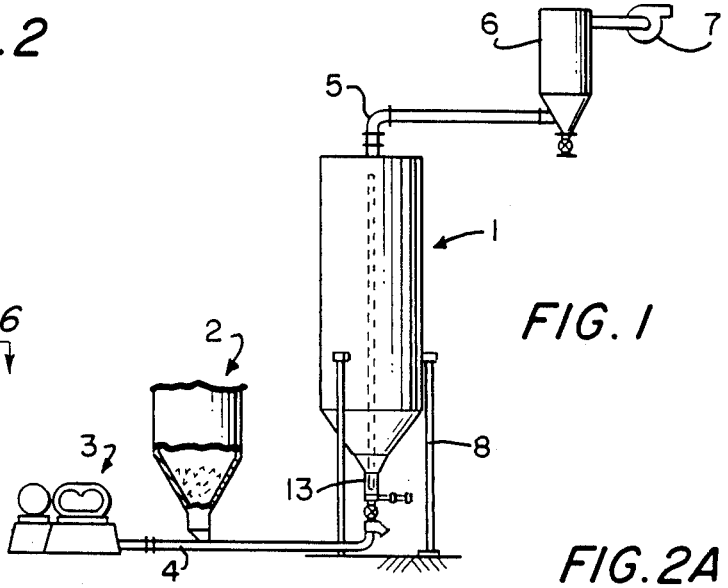
FIG. 1 is a diagramatic view of the blending system according to the present invention.

Referring to FIG. 1, the blending system according to the present invention includes a blender generally indicated at 1, a source of particulate material to be blended indicated at 2 and a source 3 of gaseous fluid under pressure such as a motor operated blower. A conduit 4 extends between the blower 3 and the inlet 13 of blender 1 for supplying gaseous fluid under pressure and entrained fresh material to be blended from the source 2 to the blender 1. Material from the source is supplied to the conduit 4 by any of the several means known in the pneumatic conveying art. A similar system is disclosed in U.S. Pat. No. 4,569,596. A vent conduit 5 is connected to a high efficiency dust collection system 6 and a fan 7. The blending vessel 1 is supported by legs 8.

Figure 2:
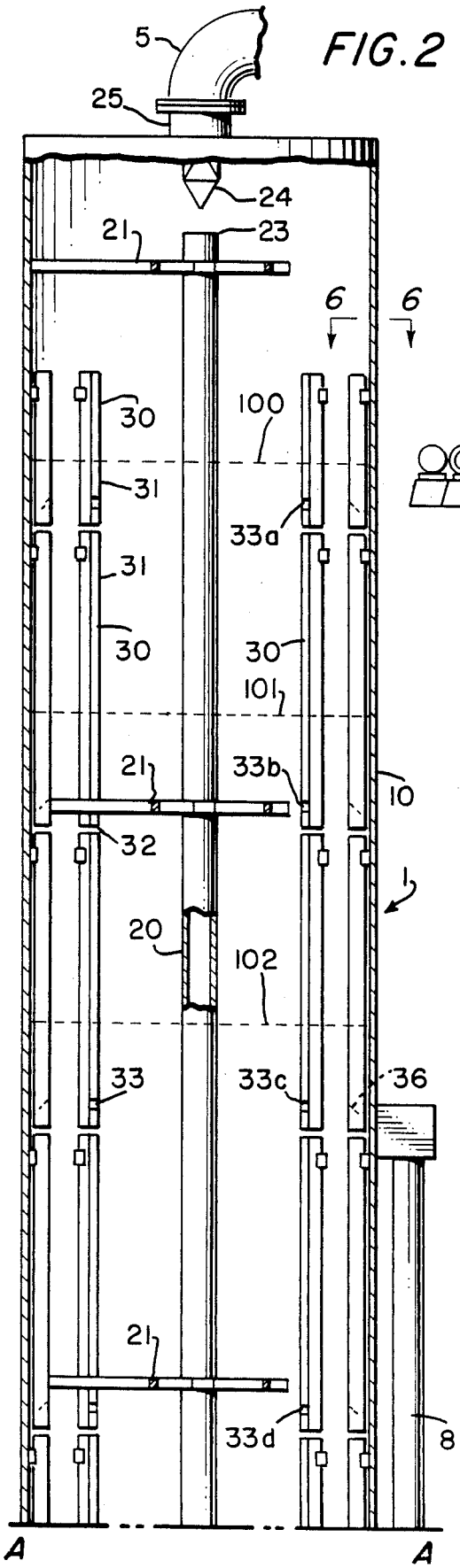
FIGS. 2 and 2A are a sectional view of the blending apparatus according to the present invention with FIG. 2A being a continuation of FIG. 2 at the line A—A.
Figure 2A:
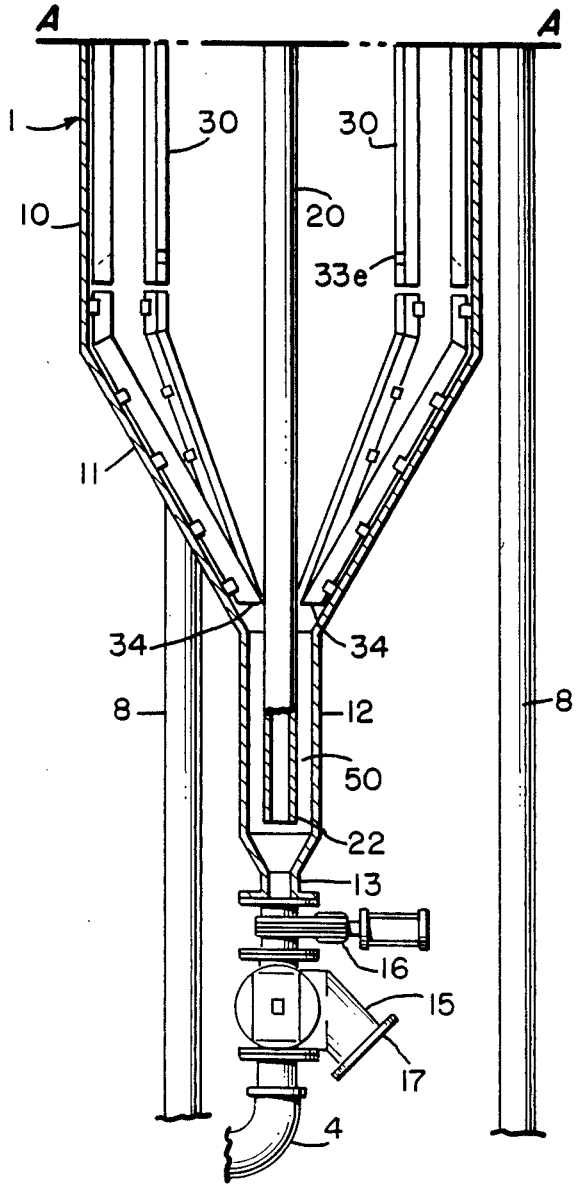

Referring to FIGS. 2 and 2A, the blender 1 includes a vertically oriented vessel lo having a hopper shaped bottom or lower end 11 and a downwardly extending tubular extension 12 centrally positioned in the lower part of the vessel 10. In the preferred form, the vessel includes a solid particulate material inlet 13 in the bottom of the tubular extension 12. This inlet 13 is connected to the conveying conduit 4 by means of a diverter valve 15. A cutoff valve or gate 16 is interposed between the conveying line 4 and the material inlet 13. With the use of the diverter valve 15, the inlet opening 13 also serves as the blender outlet. Thus, when it is desired to supply material to the blending vessel 10, material is supplied from the source 2 by entrainment in the gaseous fluid under pressure supplied from 3 and conveyed through line 4 through diverter valve 15 and open gate 16 to inlet 13. When it is desired to discharge material from the vessel 10, the diverter valve 15 is repositioned to close the passage from line 4 to inlet 13 and open a passage from opening 13 to diverted outlet 17 to permit material to flow from opening 13 through open gate 16 to outlet 17. Thus, the inlet and outlet of the vessel are coextensive.

While in the preferred form the invention includes a bottom inlet for material to be blended, it should be understood that the invention is also applicable to a blender where material is supplied to the top of the vessel and blending is achieved totally by material recirculation within the blender to be hereinafter described.

The vessel 10 includes a vertically oriented, centrally mounted blending or lift column 20 which extends downwardly into the tubular section 12 as illustrated in FIG. 2A. This blending column or lift column 20 is mounted in the vessel 10 by means of support brackets 21; best shown in FIG. 3. The column 20 is hollow and open ended and has a lower end 22 near the opening 13 within the tubular extension 12 and an upper end or outlet 23 which is near the top of the vessel 10. A distributing cone 24 may be positioned in the top of the vessel. As shown in FIG. 2, the vessel includes an outlet 25 connected to vent line 5 and high efficiency dust collector 6 (FIG. 1).

The blending apparatus also includes a plurality of recycle channels or downcomers 30 circumferentially spaced apart around the inner periphery of the vessel 10. While these recycle channels have been illustrated as being inside of the vessel and around the periphery, it should be understood that it is contemplated according to the present invention that these recycle channels 30 may be positioned outside of the vessel with suitable inlets and outlets connected to the inside of the vessel or may be positioned within the vessel at some point other than around the periphery of the vessel. A tube such as extension 12 surrouding the left column may be fitted with ports and baffles along its length and around its circumference for receiving material from these recycle channels.

Each of the recycle channels 30 includes a plurality of sections 31 which are separated from each other by a narrow gap 32. The purpose of using a plurality of sections separated by a gap is to allow for differential thermal expansion between the vessel walls 10 and the tubular channels 31. In actual practice, once the thermal expansion takes place the sections 31 will form a unitary channel 30 and in certain applications a single unitary channel could be utilized and is within the contemplation of the present invention. The various sections 31 and the channels 30 as a whole are secured to the inside of the vessel 10 by means of brackets 35.

Each of the recycle channels 30 includes at least one and preferably a plurality of vertically spaced apart openings 33 in the upper part of the vessel 10. In addition, each of the recycled channels 30 includes an outlet 34 in the lower part of the vessel 10. In the embodiment illustrated, the inlet openings 33 are uniformly spaced along the vertical length of the recycled channels 30. In addition, in the embodiment illustrated, the openings 33 in the various channels 30 are spaced at uniform levels in the vessel 10, but the invention would also be applicable to spacing the openings 33 at various levels. For example, as illustrated, the openings 33 in each channel 30 are spaced at five foot intervals, but it is also contemplated that the openings in one channel could be spaced at five toot intervals while the openings 33 in a different channel may be spaced at three foot intervals. In the preferred form, outlets 34 are located at the top of the tubular extension 12.

Each of the openings 33 includes a baffle 36 mounted therein. In the embodiment of FIG. 7, this baffle is a fixed element which extends into the interior of the channel 30. As is generally known in the prior art, when material is filled in the vessel 10 to a given level, material will flow into the channels 30 primarily through the top most opening 33 which is below the level of material and little or no material will flow into an opening below that top most opening. If a baffle element such as that illustrated at 36 is positioned in a lower opening 33, then material will flow into the channel 30 not only from the uppermost opening 33 but also from a next lower opening that includes a baffle element 36. Thus, if the level of material in the vessel is at 100, material will flow into upper opening **33*a*. Without the use of baffles 36, very little, if any, material will flow into openings 33*b* to 33*e*. If baffles 36 are placed in each opening 33 when material is at level 100, material will flow into not only top opening 33*a* but also openings 33*b* through 33*e*. When material level drops to 101, then material will flow into opening 33*b* and into baffled opening 33*c***.

If the baffle elements 36 are made movable, one can control the amount of flow into the channel 30 as well as the position from which material flows into that channel. Referring to FIG. 5 there is illustrated a movable baffle 36 which includes a flexible element or movable flow control deflector 38. One means for moving the deflector 38 is generally indicated at 40 and includes an air cylinder 41 connected to a source (not shown) of air under pressure through a line 42, a solenoid valve 43, through line 44 to the air cylinder 41. A vent line 45 is also provided. The air cylinder 41 includes a piston means 46 operatively connected to the deflector 38. The piston means 46 may be spring biased to have a normal position as shown in solid lines so that the deflector 38 extends into channel 30. When it is desired to move the deflector so that it extends out of the opening 33 and channel 30 to the position shown in broken lines the solonoid 43 is actuated so that air is supplied through lines 42 and 43 to cylinder 41 to move the piston 46 and baffle 36.

When the baffle is in the inward position illustrated in solid lines in FIG. 5 a given amount of material will flow into the associated opening 33 When the movable flow control deflector 38 is in the outward position illustrated in dotted lines in FIG. 5, then less material will flow into the associated opening 33. With respect to an opening 33 below the uppermost opening below the level of material in vessel 10, if the deflector 38 is in the inward position, some material will flow into that opening 33 which is next below the uppermost opening, but if the valve element 38 in that next lower opening is in a position extending out of channel 30, then material will not flow into that next lowermost opening.

Referring to FIG. 8, the baffle 36 extends into the channel 30 a distance a. with the channel having a width b. If the vessel 10 is empty, flow Q in the channel 30 is zero. When the material level reaches the level of the lowest port or opening 33, material will flow into the port filling the channel up to the first port. From then onward, material flows into the channel 30 at the same velocity as it is withdrawn by the recycle lift system (column 20) or by the vessel emptying process. The downward flow of material in the channel below the first port **33*e* is always the same as the withdrawal velocity, even when the material level is above the first port 33*e***.

When the material level exceeds the elevation of the second opening such as **33*d*, material starts to flow into this second port and the flow through the first port 33*e* reduces to a rate proportionate to the position of the deflector 36 into the channel. If a/b equals one third, then the rate of flow through the first port (33*e*) will be one third of the total flow and the balance will be through the second port (33*d*). This process is continued as the blender is filled. For example, when the third port (33c) is covered with material (level 102) and assuming the baffle 36 in port 33d also extends into the channel by one third i.e. a/b equals $\frac{1}{3}$, then flow through port 33d will reduce to $\frac{1}{3}(1\frac{1}{3})$ or 2/9. The flow through port 33e remains unchanged i.e. still $\frac{1}{3}$ of what flows out of the channel 30 at outlet 34**.

It should be understood that the position of deflector 38 does not have to be the same at all elevations or openings 33. For example if one uses a channel 30 with five openings 33 and the designer desires an even flow of 20 percent flow through each opening 33, then the deflectors 38 can be set to extend into the channel 30 as follows:

Port 33e; a/b=1/5
Port 33d; a/b=$\frac{1}{4}$
Port 33c; a/b=$\frac{1}{3}$
Port 33d; ab/=$\frac{1}{2}$
Port 33a; a/b=open In general, referring to FIG. 8, if the material level is higher than an opening 33, but below the next higher opening, then $Q_3$ equals $Q_2$ and $Q_1$ equals zero. If the material level is higher than an opening and the next higher opening too, then $Q_3$ equals $Q_2$ plus $Q_1$, and $Q_2$ equals a/b times $Q_3$. Thus, a means has been provided which permits the level at which material enters the recycle channel to be controlled. With a blender, this is particularly significant since in a blender application, material may now be withdrawn from both the top most opening and one of several lower openings to thereby blend material at the top of the vessel with material withdrawn at a selected lower level of the vessel.

In operation of the blender according to the present invention, material is supplied from the source through conveying line 4 and the energy used to supply material to the blending vessel up through inlet 3 also conveys material up the lift column 20 where it spills out of the top outlet 23 of the column 20 in a geyser like manner into the top vessel 10. Material which is in the vessel fills the tubular extension 12 and is entrained in the gaseous fluid under pressure conveying fresh material from the source 2 whereby the material already in the vessel is also conveyed up the lift column 20 to thereby blend material already in the vessel with fresh material being supplied to the vessel. Of course, if there is no fresh material being supplied through conduit 4, air under pressure is supplied through conduit 4 up through column 20 to entrain material already in the vessel up through column 20 to circulate material through the vessel to achieve blending.

It has been discovered through testing that blending is improved if recirculation of material from the upper regions of the vessel is supplied for entrainment with fresh material being supplied to the vessel. In order to accomplish this, the recirculation channels 30 are added to supply material from the upper part of the vessel to the lower part of the vessel. It has also been discovered that in order to properly mix the material already in the vessel with incoming feed material and with material discharged from the outlets 34 of the recirculation channels 30, it is necessary to provide a seal between the lower end of the lift column 20 and the inside of the vessel 10. The tubular extension 12 together with the lower end of the lift column 20 define a seal leg 50. The column 20 and the tubular extension are dimensioned to define a seal leg to enable a major portion of the gaseous fluid under pressure being supplied through inlet 13 to be directed upwardly through the lift column 20. If the seal leg is not utilized, it is believed that material will bridge at the bottom of the blender cone and substantially no material will be recycled from the inside of the vessel up through column 20. The pressure drop across the column 20, i.e., between the inlet 22 and the outlet 23 must be less than the pressure needed to fluidize material within the extension 12. The important factors in dimensioning the seal leg will be apparent to those skilled in the art and include the air pressures used, the particle size and density, the length and diameter of the lift column 20, the length and diameter of the tubular extension 12 and the number of channels 30. This seal leg will ensure that material being supplied into the blender through line 4 will properly mix with material already in the blender at the seal leg 50. The seal also ensures that if only recirculated air is being supplied through conduit 4, then material which is recirculated through channels 30 from the upper part of the vessel to the lower part is entrained in the air.

During blending operations it may be necessary to recycle material if total blending does not take place during the conveying-blending cycle. In such an instance, the supply of fresh material from source 2 will be stopped and gaseous fluid under pressure will be continued o be supplied through line 4 and inlet 13 to entrain material in the vessel 10 and seal leg 50 up through blending column 20 to spill out onto the vessel 10 in a geyser-like manner through outlet 23. Material already in the vessel is supplied through recycle channel inlets 33 in the manner described above to outlets 34 and the top of the seal leg 50. As material in the lower end of extension 12 is entrained in the blending air and conveyed into inlet 22 of column 20, material from outlets 34 will move by displacement down the length of the seal length 50 to the inlet 22 of lift column 20. Material also enters the tubular extension 12 from the hopper bottom 11 so that material from the top of the blender is mixed with material from the bottom of the vessel 10. Thus, material from the upper part of the vessel 10 is withdrawn through channels 30 to the lower part of the vessel 10 for recirculation back through lift column 20 and is blended with material from the lower part of the vessel falling by gravity through hopper 11. If the vessel 10 is provided with a top inlet for fresh material, this recirculation provides the means for blending.

In some embodiments it may be desirable to provide a arrangement whereby a larger percentage of material flows either directly from the inside of the vessel to the inlet 23 to the blending column and a further means for controlling the flow of material in the recycle columns 30. Such an apparatus is illustrated in FIG. 4. In this embodiment, the recycle channels may include a pinch valve 60 mounted in the lower end therein for controlling the flow of material through a channel 30 into the lower region of the vessel 10. This pinch valve may be a pneumatically operated device including a diaphragm 61 connected to source of air under pressure (not shown). When the diaphragm is inflated, the channel 30 can be closed. Partial inflation of the diaphragm will mean partial closing of the channel.

The embodiment of FIG. 4 also illustrates a cone shaped member 65 at the bottom of the column 20 and an annular pinch valve 66 including air actuated diaphragm 67 which can serve to close the space between the bottom of the cone 65 and the bottom 68 of the vessel 10. In this way, the flow of material from the lower part of the vessel into the left column 20 can be controlled. In this embodiment, the lift column 20 is not illustrated as extending into a seal leg but terminates in the upper part of the vessel but the use of a seal leg in this embodiment is within the contemplation of this invention. Also in this embodiment, the material outlet has been illustrated at 117 and the inlet for gaseous fluid under pressure used for blending has been illustrated at 104.

From the foregoing it should be apparent that the objects of this invention have been carried out. An improved blender is provided which ensures that material in the upper part of the blender may be recirculated to the bottom of the blender for proper mixing of fresh material being supplied to the blender and proper mixing of material in the top of the blending vessel with material in the bottom of the blending vessel. The energy used to supply material to the vessel through conduit 4 is also used to blend the fresh material with material already in the vessel. In addition, an apparatus has been provided which is capable of selectively withdrawing material from various points in the vessel and mixing it with material withdrawn from other point in the vessel through the use of the moveable flow control deflectors at various levels in the vessel. This improves the flexibility of the apparatus.

It is intended that the foregoing be a description of a preferred embodiment and that the invention be limited solely by that which is within the scope of the appended claims.

I claim:

1. Apparatus for blending solid particulate material compromising a vertically oriented vessel having an upper part and a lower part, an inlet for particulate material to be blended, an outlet for blended particulate material and a tubular extension on the lower part thereof; a vertical lift column centrally mounted in said vessel having a lower part extending into said tubular extension and including an inlet within said tubular extension and an outlet in the upper part of the vessel; at least one recycle channel associated with said vessel having at least one inlet for receiving particulate material from the upper part of the vessel and an outlet for returning particulate material to the lower part of the vessel; means for supplying gaseous fluid under pressure to said tubular extension below said lift column for entraining material in the tubular extension below said lift column into the inlet of the lift column and upwardly through the lift column whereby material is discharged from the outlet of said lift column in a geyser-like manner into the upper part of the vessel; said tubular extension and the lift column being dimensioned to define a seal leg so that the pressure drop across the lift column is less than the pressure drop required to fluidize material in the tubular extension to enable a major portion of said gaseous fluid to be directed upwardly through the lift column; said tubular extension has a top portion and a bottom portion and the outlet of the recycle channel is near the top of the tubular extension, the inlet of the lift column is near the bottom of the tubular extension and the means for supplying gaseous fluid under pressure is connected to the bottom portion of the tubular extension.

2. Apparatus for blending solid particulate material according to claim 1 wherein the inlet of the vessel is positioned in the bottom portion of said tubular extension, coaxially aligned with said lift column, and said means for supplying gaseous fluid under pressure entrains fresh material to be blended to said inlet and upwardly through said lift column and entrains material already in the vessel through the lift column to thereby blend the material.

3. Apparatus for blending solid particulate material according to claim 2 wherein there are a plurality of circumferentially spaced apart recycle channels mounted around the periphery of said vessel.

4. Apparatus for blending solid particulate material according to claim 1 wherein said inlet of said recycle channel includes baffle means and said apparatus further comprises means for moving the position of said baffle means.

5. Apparatus for blending solid particulate material according to claim 4 further comprising a flow control valve mounted in said recycle channel for stopping the flow of material through said recycle channel.

6. Apparatus for blending solid particulate material according to claim 5 wherein the outlet of the vessel is coextensive with the inlet of the vessel and valve means is provided in said inlet.

7. Apparatus for blending solid particulate material according to claim 1 wherein there are a plurality of circumferentially spaced apart recycle channels mounted around the periphery of said vessel.

8. Apparatus for blending solid particulate material according to claim 1 wherein said tubular extension includes an elongated section that terminates in a conical section and the inlet of the lift column is in the elongated section, above the conical section of the tubular extension.

9. In an apparatus for blending solid particulate material including a vertically oriented vessel having an upper part, a lower part, an inlet for material to be blended and an outlet for blended material and at least one generally vertical recycle channel associated with said vessel having at least one inlet communicating with the upper part of the vessel and an outlet, a flow control deflector operatively associated with said recycle channel inlet for controlling the flow of material into said recycle channel, the inlet of said recycle channel being a generally horizontal opening and said flow control deflector includes a baffle for partially closing said horizontal opening, the improvement comprising means for moving said baffle between a position where the baffle extends partially into the channel and a position where the baffle extends out of the channel.

10. Apparatus for blending solid particulate material according to claim 9 wherein there are a plurality of vertically spaced apart inlet openings in said recycle channel, each communicating with a progressively lower level of said vessel and each having a moveable flow control deflector operatively associated therewith.

11. Apparatus for blending solid particulate material according to claim 10 the improvement further comprising said vessel having a tubular extension extending downwardly from the lower part of the vessel, a lift column centrally mounted in said vessel and extending into said tubular extension and means for supplying gaseous fluid under pressure to said tubular extension for entraining material in the vessel and conveying it up the lift column in a geyser-like manner into the upper part of the vessel.

12. Apparatus for blending solid particulate material according to claim 11 wherein the outlet of each recycle channel is connected to the tubular extension.

13. Apparatus for blending solid particulate material according to claim 12 wherein said tubular extension and the lift column are dimensioned so that the pressure drop across said lift column is less than the pressure drop required to fluidize material in the tubular extensions.

14. Apparatus for blending solid particulate material according to claim 11 wherein the tubular extension has a top portion and a bottom portion and the outlet of the recycle channels are connected near the top of the tubular extension, the lift column has an inlet and the lift column extends into the tubular extension a distance sufficient to position its inlet near the bottom of the tubular extension, and the means for supplying gaseous fluid under pressure tot he lift column is connected near the bottom of the tubular extension.

* * * * *